US005996712A

United States Patent [19]

Boyd

[11] Patent Number: 5,996,712

[45] Date of Patent: Dec. 7, 1999

[54] MECHANICAL LOCKING SWIVEL APPARATUS

[76] Inventor: Harper Boyd, 714 Newton St., Lake Charles, La. 70605

[21] Appl. No.: 09/002,666

[22] Filed: Jan. 5, 1998

Related U.S. Application Data

[60] Provisional application No. 60/035,810, Jan. 8, 1997.

[51] Int. Cl.[6] ..... E21B 19/18; E21B 15/04

[52] U.S. Cl. ..... 175/321; 166/242.7; 464/163

[58] Field of Search ..... 175/321, 320; 464/18, 19, 162, 163; 166/242.5, 242.7; 164/179

[56] References Cited

U.S. PATENT DOCUMENTS

| | | | |
|---|---|---|---|
| Re. 33,150 | 1/1990 | Boyd | 166/242.5 |
| 2,016,042 | 10/1935 | Lewis | 175/320 |
| 2,100,418 | 11/1937 | Welikanov | 175/320 |
| 4,064,953 | 12/1977 | Collins | 175/321 |
| 4,506,729 | 3/1985 | Davis | 166/242.5 |
| 4,572,305 | 2/1986 | Swietlik | 175/321 |
| 5,314,032 | 5/1994 | Pringle et al. | 175/321 |
| 5,495,901 | 3/1996 | Livingstone et al. | 175/74 |

*Primary Examiner*—David Bagnell
*Assistant Examiner*—Chong S. Cho
*Attorney, Agent, or Firm*—Garvey, Smith, Nehrbass & Doody, LLC

[57] ABSTRACT

A mechanical swivel apparatus which has a first upper body portion threadably attached to the lower end of a side entry sub apparatus, and a second lower portion which is threadably attached to a section of drill pipe, the apparatus positionable above the rotary table on the rig floor, and having a continuous bore therethrough for running wireline or the like. The upper body portion includes a counterbore for receiving the upper end of a mandrel, so that the mandrel is able to move within the counterbore of the upper body portion. The lower portion comprises an open-ended cap member which threadable engages the upper body portion, and has a shoulder portion which engages a flange around the body of the mandrel so that the mandrel is allowed to move within the upper body portion but cannot be slidably removed therefrom. On its upper end, the mandrel portion further includes a plurality of outwardly extending teeth which define spaces therebetween, so that a pair of pin members extending into the counterbore in the upper body portion, at a first position, engage the teeth so that the mandrel portion is locked in place with the body portion. In a second position, the teeth on the mandrel are moved out of position from the pins, allowing the mandrel, and the drill string below the mandrel to move freely. In operation, the pins are engaged within the inner spaces between the teeth so that when the upper body portion is rotated, the mandrel is rotated and in a second position when the body portion moves to a down position, the pins are disengaged from the teeth so that the lower mandrel portion can remain stationary while the upper body portion is rotated.

15 Claims, 5 Drawing Sheets

MECHANICAL LOCKING SWIVEL APPARATUS

CROSS-REFERENCE TO RELATED APPLICATIONS

Priority of U.S. Provisional Patent Application Ser. No. 60/035,810, filed Jan. 8, 1997, is hereby claimed. That application is hereby incorporated by reference.

BACKGROUND OF THE INVENTION

1. Field of the Invention

The apparatus of the present invention relates to locking swivels. More particularly, the present invention relates to a mechanical locking swivel positionable above the rig floor for allowing the reorientation of a bent sub during a directional drilling without having to withdraw a wireline that has been located within the drill string from above the rig floor.

2. General Background of the Invention

In the drilling of oil wells, one of the more frequent types of wells that are drilled are directional wells. Rather than have to drill a well vertically, often times because of the location of the pocket of hydrocarbons, or for other reasons, the direction of the well has to be altered or done in a direction off of the vertical and is termed a directional well. This is accomplished with the use of a type of a bent sub which is placed on the lower end of the drill string and the drill bit is rotated downhole via a motor known as a dynadrill. The bent sub, when it is oriented in a particular pre-determined orientation, will have the bit drill travel in that particular orientation as a directional well.

Quite often in the drilling process, the direction of the drill bit has been mis-oriented and has to be adjusted slightly in order to reorient the bit in the proper direction. In most cases, this can easily be accomplished by setting the drill string via the slips, and rotating the rotary table slightly so that the entire drill string is re-oriented and then drilling can resume at that orientation. However, in the instance when there is a wireline which has been fed down into the drill string, because the wireline is usually fed through a side entry sub apparatus, the string cannot be rotated due to the fact that would put stress on the wireline itself, which may result in the wireline being cut and the tool at the end of the wireline could be lost within the well bore, which would result in the tool having to be retrieved if possible. This is time consuming and expensive and requires that the well be shut down in order to do so. However, in the current state of the art, in order to reorient the drill bit while a wireline is downhole, the tool at the end of the wireline has to be retrieved from the well. Next, the drill string has to be reoriented in the proper direction and then the wireline would be re-fed down into the drill string for undertaking its work downhole. Again, this is time consuming and results in loss of rig time. There are also devices known in the industry which attempt to provide a means by which the drill string can be oriented without having to orient the upper portion of the drill string above the rig floor where the wireline is being fed. These types of tools are known as swivels, and to some extent are successful to a certain point.

Therefore, there is a need in the art for a tool that can be easily engaged and disengaged at that point between the side entry sub from where the wireline is being fed and the lower drill string, so that the orientation of the drill bit can be changed without placing stress on the wireline.

BRIEF SUMMARY OF THE INVENTION

The apparatus of the present invention solves the short comings in the art in a simple and straight forward manner.

What is provided is a mechanical swivel apparatus which has a first upper body portion threadably attached to the lower end of a side entry sub apparatus, and a second lower portion which is threadably attached to a section of drill pipe, the apparatus positionable above the rotary table on the rig floor, and having a continuous bore therethrough for running wireline or the like. The upper body portion includes a counterbore for receiving the upper end of a mandrel, so that the mandrel is able to move within the counterbore of the upper body portion. The lower portion comprises an open-ended cap member which threadable engages the upper body portion, and has a shoulder portion which engages a flange around the body of the mandrel so that the mandrel is allowed to move within the upper body portion but cannot be slidably removed therefrom. On its upper end, the mandrel portion further includes a plurality of outwardly extending teeth which define spaces therebetween, so that a pair of pin members extending into the counterbore in the upper body portion, at a first position, engage the teeth so that the mandrel portion is locked in place with the body portion. In a second position, the teeth on the mandrel are moved out of position from the pins, allowing the mandrel, and the drill string below the mandrel to move freely.

In operation, the pins are engaged within the inner spaces between the teeth so that when the upper body portion is rotated, the mandrel is rotated and in a second position when the body portion moves to a down position, the pins are disengaged from the teeth so that the lower mandrel portion can remain stationary while the upper body portion is rotated. There is further included a plurality of seals and the like for sealing off the engagement of the surfaces between the moving parts of the body portions and the mandrel so that any fluid being flowed down through the bore in the tool is prevented from leaking out of the apparatus.

Therefore, it is a principal object of the present invention to provide a mechanical swivel apparatus which mechanically engages and disengages so that the drill string below the apparatus can be rotated while the portion of the drill string above the apparatus remains stationary.

It is a further object of the present invention to provide a mechanical swivel apparatus which is inserted along the drill string between an upper side entry sub through which wireline is fed, and the lower drill string, so that when the lower drill string must be rotated in order to properly orient the drill bit, the tool body can be placed in the disengaged position and the upper portion, including the side entry sub with the wireline, remains stationary, while the drill string is rotated to the proper orientation.

It is a further object of the present invention to provide an apparatus positioned within the drill string above the rig floor which provides a mechanism to allow rotation of the drill string below the apparatus and to provide that the portion of the drill string above the apparatus remain stationary during wireline operations if orientation of the drill bit is necessary.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
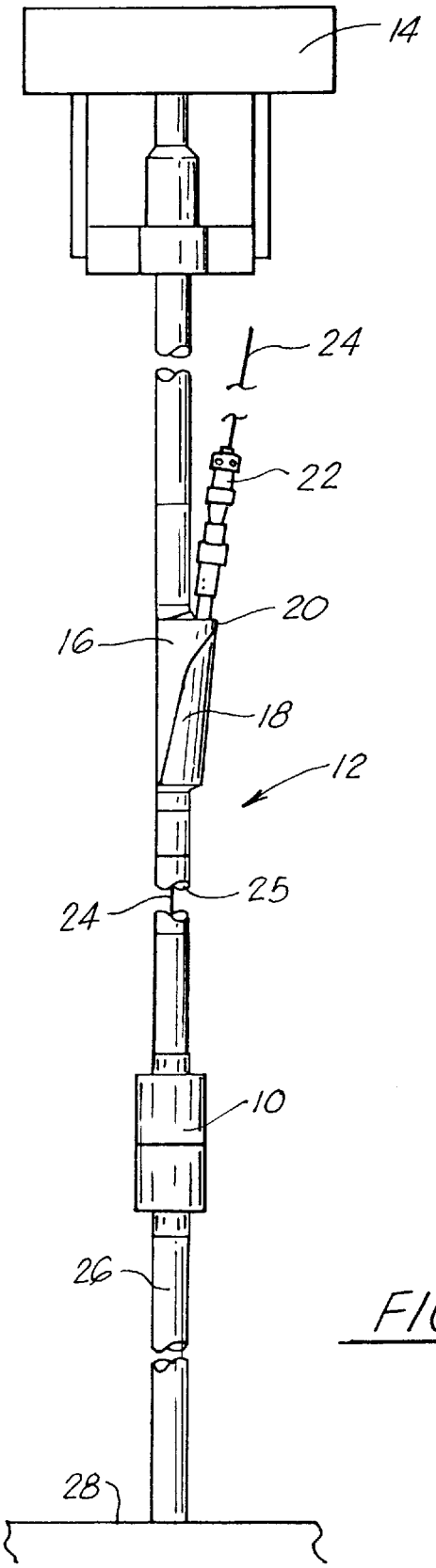
FIG. 1 illustrates an overall view of the preferred embodiment of the apparatus of the present invention within a drill string.

FIGS. 1–5 illustrate the preferred embodiment of the apparatus of the present invention by the numeral 10. As illustrated in overall view in FIG. 1, there is illustrated the mechanical swivel apparatus 10 placed within a drill string 12, the drill string as illustrated including an upper drive assembly 14, a side entry sub apparatus 16, of the type that is claimed and disclosed in U.S.

Pat. Re No. 33,150, owned by Boyd's Bit Service, Inc., which, as illustrated includes a principal body portion 18, and an angulated portion 20 having an upper fixture 22 for feeding a wireline 24, as seen in partial view, down through a bore in the assembly 22 and principal body 18, and down through the bore in the drill string 12 as illustrated. The assembly 10, as illustrated, would be connected on its lowermost end to a section of drill pipe 26, which is seen being moved into or out of the drill hole at the level of the rotary table 28. In this particular embodiment, although not illustrated, on the lower end of the drill string there would be included a drill bit which would be operated by a dynadrill apparatus which is commonly known in the industry, and most likely there would be included a bent sub unit adjacent the dynadrill so that the drill bit would be drilling in a directional orientation.

In discussing the particulars of apparatus 10 as illustrated in FIG. 1, reference is made to FIGS. 2–5. As illustrated, apparatus 10, as was discussed earlier, would be connectedly engaged on its upper portion to perhaps a sub 28 which may be a wear sub which would be utilized in conjunction with the side entry sub apparatus 16. The sub would be threadably engaged via threads 30 to the upper body portion 32 of the apparatus, through a pin and box connection as illustrated. The upper body portion 32 would include a bore portion 34 which would be substantially the same size bore as the drill pipe 26 and the sub 28. The bore 34 of the upper body portion 32 would form an expanded counter bore area 36 for receiving the upper end 38 of a mandrel 40, the purpose of which will be described further. As further illustrated, the lower end of the body portion 32 would form a pin and box threaded connection 42 to a lower cap member 44. Lower cap member 44, when threaded to the lower end of the body portion 32, provides a bore in which the mandrel travels, and includes a lower shoulder 45, the function of which will be described below.

Figure 2:
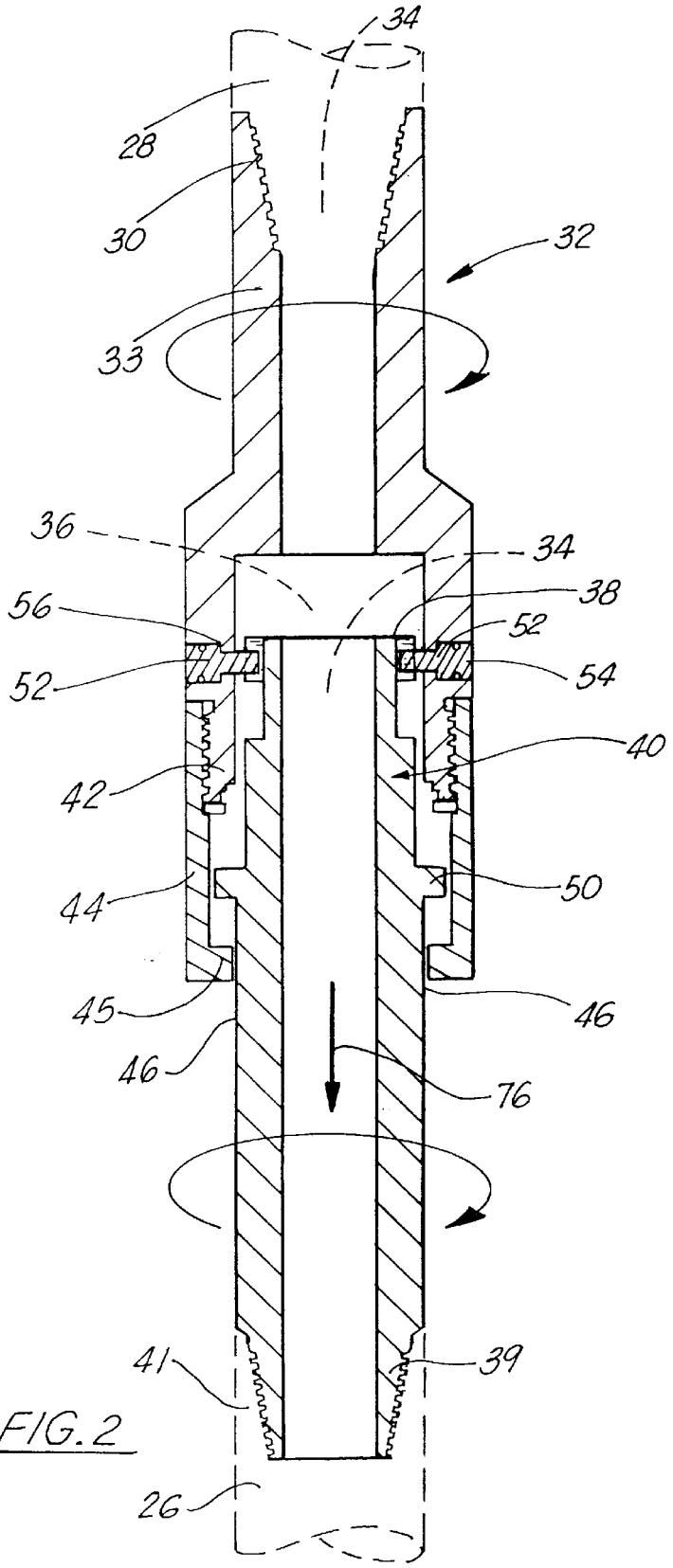
FIG. 2 provides a cross section view of the preferred embodiment of the apparatus of the present invention in the engaged position.

As further illustrated in FIG. 2, reference is made to mandrel 40, which as was stated earlier, includes the upper end 38 and the lower pin end 39, which would be threadably engaged to the box end 41 of drill pipe 26. Like body portion 32, mandrel 40 would also include a continuous bore 34 that would be basically continuous with the bore of the upper body portion 32 and cap 44. Mandrel 40 would include a continuous side wall 46 which would be of a diameter slightly less than the internal diameter 47 of the shoulder 45 formed by the lower end of cap portion 44, and including an annular flange 50 around its wall 46. As illustrated, after mandrel 40 has been inserted into the counter bore 36 of upper body portion 32, the cap member 44 is threadably engaged to the lower end 42 of upper body portion 32. The threadable engagement between cap 44 and lower end 42 would be through a left hand thread rather than the normal right hand thread when threaded connections are made up. It should be noted that once cap member 44 is threaded in place, the annular flange 50 formed around the wall 46 of mandrel 40 extends outward further than the opening 47 of cap member 44, thus the mandrel 40 cannot become disengaged from within the counter bore 36 for the reasons as will be described further.

Figure 4:
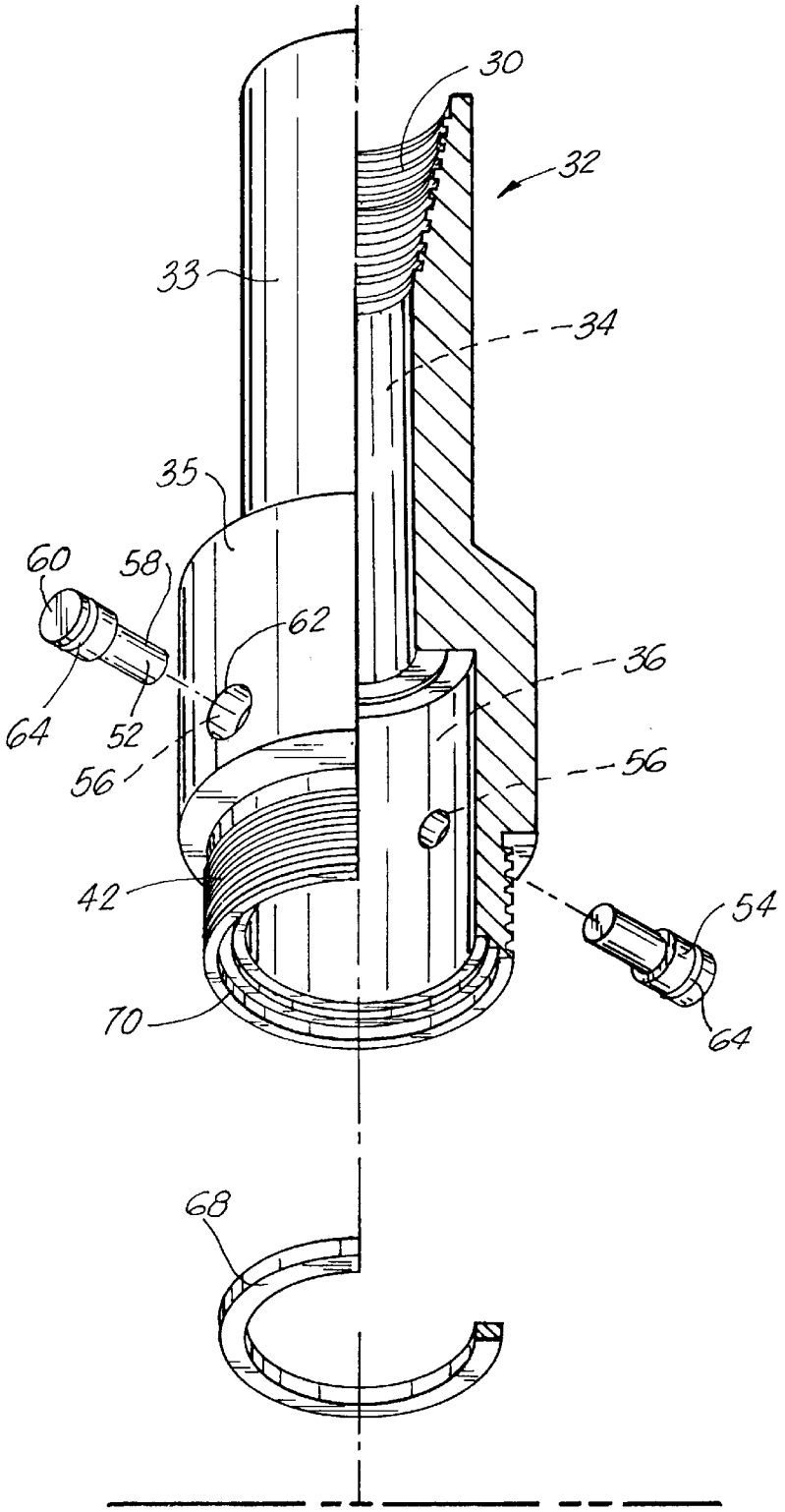
FIG. 4 illustrates a partial cut away view of the upper body portion of the preferred embodiment of the apparatus of the present invention.

Turning now to the particular construction of each of the portions prior to a discussion of functioning, reference again is made for example to FIG. 4, which illustrates the particular construction of the upper body portion 32. As was stated earlier, upper body portion 32 includes an upper neck portion 33 which is threadably engaged at threads 30 to a lower sub 28 as was seen in FIG. 1. There is again as illustrated in FIG. 4, a continuous bore 34 through the body portion which expands into an enlarged counter bore 36. As illustrated, the neck portion 33 then forms a thickened lower body portion 35 in which the counter bore 36 is formed, which then results in the lower threaded end 42 of the body portion 32, which would then threadably engage with cap member 44, which is illustrated in composite view in FIG. 5. Continuing with FIG. 4, there is included a pair of pins 52, 54, each of the pins frictionally engaged into openings 56 in being substantially 180 degrees apart, each of the pins including a shaft portion 58 and a head portion 60 with the head portion 60 forming a frictional engagement against the inner wall 62 of opening 56. There would be further included an O ring 64 in a groove formed in each of the heads 60 of the pins, so as to form a seal between the wall 62 and the head 60, so that any fluid flowing through bore 34 and counter bore 36 would be prevented from flowing out of the opening 56 during operation. There is further included a ring 68 formed of Teflon or the like which would rest around a lower shoulder 70 of lower body portion 35 so as to form a smooth mating surface between the ring 68 and the flange 50 of mandrel 40 during operation.

Figure 5:
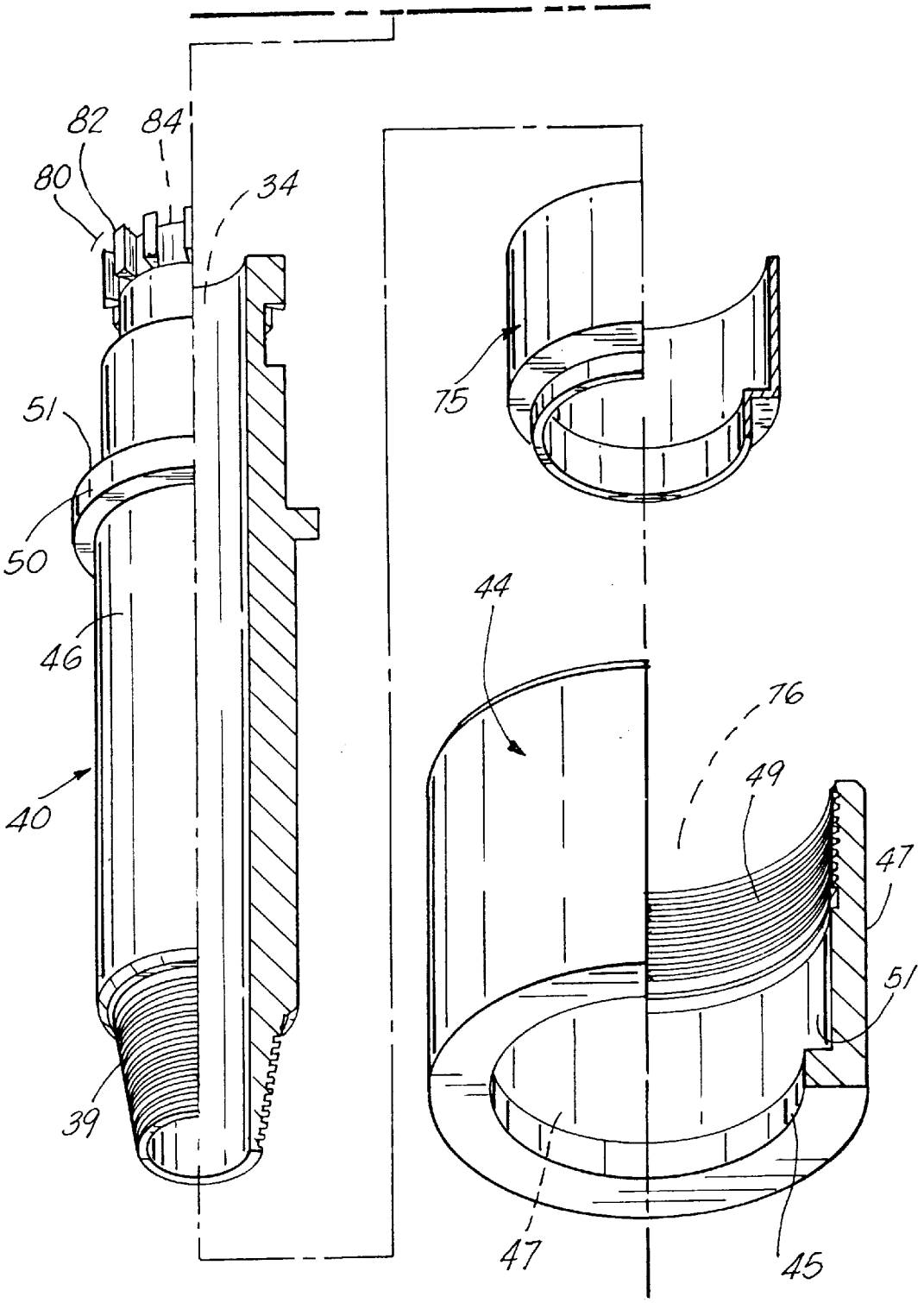
FIG. 5 illustrates a composite cut away view of the lower mandrel portion including the lower cap and brass collar member of the preferred embodiment of the apparatuses of the present invention.

Turning now to FIG. 5, there is illustrated in composite view, the mandrel 40, the lower collar 44, and a brass ring member 75. As illustrated, mandrel 40, as was stated earlier, has a continuous wall 46 and a continuous bore 34 therethrough which would coincide with the continuous bore of body portion 32 for continuous flow of fluid down the drill string and allows the continuous movement of wireline as indicated by arrow 76 in FIG. 2. Further as illustrated and was stated earlier, mandrel 40 includes the continuous annular flange 50, the upper surface of which 51 rests against the Teflon member 68 as was discussed earlier. Further, the mandrel includes a lower pin end 39 which would threadably engage into a length of drill pipe 26, as was seen in the discussion of the apparatus in FIGS. 1 and 2. On the upper end of mandrel 40, there is included an engagement means 80. This engagement means 80 includes a plurality of spaced apart teeth members 82 defining spaces 84 therebetween. The spaces 84 would be slightly larger in diameter than the diameter of the shaft portion 58 of each of the pin members 52, 54, for the reasons as will be discussed further. As further illustrated in FIG. 5, the lower cap 44 is illustrated with its inwardly extending shoulder 45 from its continuous wall portion 47. The cap as was stated earlier includes a series of upper threads 49 which threadably engage to the lower end 42 of body 32, for the reasons as stated earlier. As further illustrated in FIG. 5, there is a brass collar 75. Brass collar 75 would be slidably engaged within the central opening 76 formed within cap member 44 and would loosely fit against the wall 51 of cap member 44 so as to serve as a protective barrier between the mandrel 40 and the cap member 44 while the tool is at rest so as to help to prevent rust or the like from forming.

Figure 3:
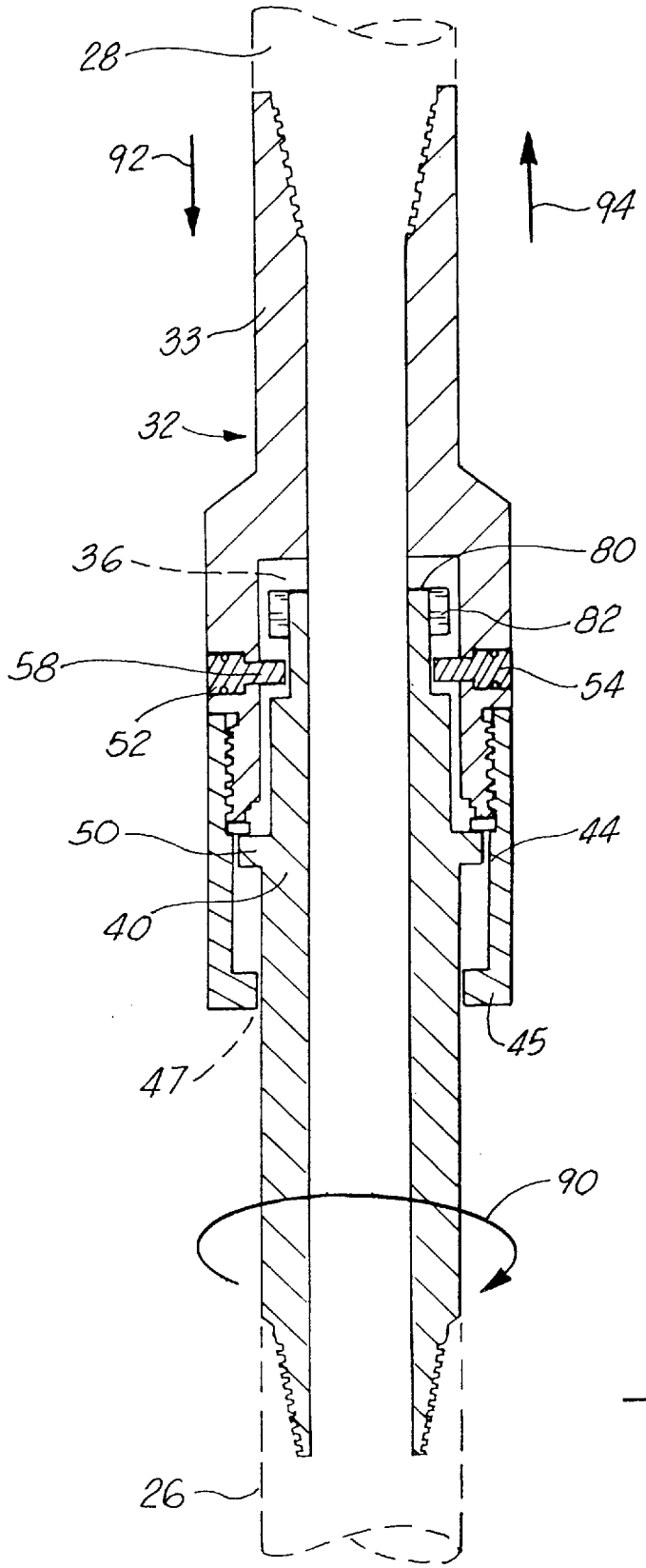
FIG. 3 illustrates a cross section view of the apparatus of the present invention in the disengaged position.

Reference now is made to FIGS. 2 and 3 for a discussion of the overall operation of the tool. As seen in FIG. 2, the mandrel 40 is in position within the counter bore 36 of body portion 32 and the mandrel is maintained within the opening 36 of body portion 32 via the cap portion 44 that has been engaged thereto. It is seen that the pins 52, 54 which are in position through the wall of the body portion 32 that the shaft portions 58, which are projected into the counter bore 36, are engaged within two of the spaces 84 formed between the teeth members 82. In this position the mandrel therefore, is locked in place with body portion 32 and cap 44, for example, while the drilling is taking place by the directional drill bit. In the event that the drill bit needs to be reoriented, reference is made to FIG. 3, where the upper body portion 32 again is illustrated threadably engaged to the cap member 44 with the mandrel 40 secured within counter bore 36. However, in this position, the teeth 82 of the end 80 of mandrel 40 have been moved out of alignment with the shaft 58 of pins 52, 54 so that the mandrel 40 is free to rotate freely in the direction for example of arrow 90, without the upper body portion 32 and cap 44 rotating. This is accomplished by securing the section of drill pipe 26 which is projecting into the rotary table by the slips on the rotary table. When this is accomplished, the drill string 12 above the rotary table as illustrated in FIG. 1, is then moved in the direction of arrow 92 as seen in FIG. 3. Since the mandrel is threadably secured to the now stationary drill pipe 26, as the upper portion of the tool is moved slightly downward in the direction of arrow 92, the pin members 52, 54 move out of alignment with teeth members 82. When this is accomplished, the mandrel 40, together with the drill pipe 26 below the mandrel, is free to rotate while the upper body portion 32, and the assembly above it, remaining stationary. The rotary table 28 can then be rotated the number of degrees necessary to properly align the drill bit without the upper portion of the tool 32 and anything above it, including the side entry sub 16, having to move. After the drill bit has been properly oriented, the upper portion of the drill string 12 is moved slightly upward in the direction of arrow 94 until the shafts 58 of 52, 54 are reengaged within the inner spaces 84 between teeth 82, so that the entire drill string now becomes stationary as one fixed string.

Therefore, this mechanical swivel apparatus, by allowing engagement and disengagement between portions of the apparatus, has allowed one portion of the apparatus to remain stationary while a second portion of the apparatus is movable. This gives the driller the ability to rotate that portion of the drill string below the upper portion of the apparatus without having to rotate the upper portion of the apparatus and anything above it at all. By doing this, this eliminates any potential problem that one would arise should the side entry sub have to be rotated with the wireline engaged through it which would put unneeded stress on the wireline and perhaps rupture it.

The foregoing embodiments are presented by way of example only; the scope of the present invention is to be limited only by the following claims.

I claim:

1. A mechanical swivel apparatus, comprising:

a. an upper body portion, having a bore therethrough and positionable in a drill string below the entry of a wireline into the drill string;

b. a lower member secured to the upper body portion, having a bore therethrough and open on its lower end;

c. a mandrel, positioned within the bores of the upper body portion and the lower member, and secured on its lower end to the drill string;

d. a pin on the upper body portion extending into the bore of the upper body portion; and e. means on an upper end of the mandrel portion for defining a space for receiving the pin on the upper body portion, to engage the mandrel to the upper body portion when the mandrel is in a first position, and to disengage the upper body portion, when the mandrel is in a second position.

2. The apparatus in claim 1, wherein the upper body portion threadably engages to the drill string below a sub which receives a wireline into the drill string.

3. The apparatus in claim 1, wherein there is provided at least two pin members extending into the bore of the upper body portion, the pin members positioned 180 degrees apart.

4. The apparatus in claim 1, wherein the mandrel further comprises an annular flange around its wall portion which resides within the bore of a cap member.

5. The apparatus in claim 4, wherein the cap member further comprises a shoulder portion which engages the annular flange of the mandrel as the mandrel moves within the bore.

6. The apparatus in claim 1, wherein there is further provided a brass sleeve residing between the cap member and the mandrel for providing protection against rusting.

7. The apparatus in claim 1, wherein there is further provided a tetrafluoroethylene ring defining a traveling surface between the mandrel and the upper body member.

8. The apparatus in claim 1, wherein the means on the upper end of the mandrel further comprise a plurality of spaced apart teeth members defining spaces therebetween for allowing the pin member to engage therebetween ground the circurference of the mandrel.

9. A mechanical swivel apparatus, positionable along a drill string, below the entry of a wireline, the apparatus comprising:

a. an upper body portion, having a bore therethrough and having an upper end threadably connected to a sub;

b. a lower cap member secured to the upper body portion, having a bore therethrough and open on its lower end;

c. a mandrel, positioned and moveable within the bores of the upper body portion and the lower cap member, and secured on its lower end to the drill string below the apparatus;

d. a pair of pins in a wall of the upper body portion and extending into the bore of the upper body portion; and e. means on an upper end of the mandrel portion for defining spaces for receiving the pins on the upper body portion for engaging the mandrel to the upper body portion, and when the mandrel is moved to a second position, to disengage the pins from the spaces and rotate freely from the upper body portion.

10. The apparatus in claim 9, wherein the pins extending into the bore of the upper body portion are positioned 180 degrees apart.

11. The apparatus in claim 9, wherein the mandrel further comprises an annular flange around its wall portion which resides within the bore of the cap member, and engages a shoulder portion at a lower end of the lower cap member as the mandrel moves within the bore.

12. The apparatus in claim 9, wherein there is further provided a brass sleeve residing between the cap member and the mandrel for providing protection against rusting.

13. The apparatus in claim 9, wherein there is further provided a tetrafluoroethylene ring defining a traveling surface between the mandrel and the upper body member.

14. The apparatus in claim 9, wherein the means on the upper end of the mandrel further comprise a plurality of spaced apart teeth members defining spaces therebetween for allowing the pin member to engage therebetween around the circumference of the mandrel.

15. A mechanical swivel apparatus useable during wireline operations, positionable along a drill string, for allowing a portion of a drill string above the apparatus to remain stationary while a portion of the below the entry of a wireline, the apparatus comprising:

a. an upper body portion, having a bore therethrough and having an upper end threadably connected to a lower end of a side entry sub unit;

b. a lower cap member secured to the upper body portion, having a bore therethrough and open on its lower end;

c. a mandrel, positioned and moveable within the bores of the upper body portion and the lower cap member, and secured on its lower end to the drill string below the apparatus;

d. a pair of pins in a wall of the upper body portion and extending into the bore of the upper body portion; and e. a plurality of teeth on an upper end of the mandrel portion for defining spaces for receiving the pins on the upper body portion for engaging the mandrel to the upper body portion, and when the mandrel is moved to a second position, the pins are disengaged from the spaces, allowing the mandrel and that portion of the drill string to rotate freely from the upper body portion and that portion of the drill string above the upper body portion.

* * * * *